US007533948B2

(12) United States Patent
Smith et al.

(10) Patent No.: US 7,533,948 B2
(45) Date of Patent: May 19, 2009

(54) ADJUSTABLE SHELVING SYSTEM

(75) Inventors: Jimmy S. Smith, Saltillo, TN (US); Moe H. Majordy, Parsons, TN (US); Bryan T. Alexander, Sardis, TN (US)

(73) Assignee: Manitowoc Foodservice Companies, Inc., Reno, NV (US)

( * ) Notice: Subject to any disclaimer, the term of this patent is extended or adjusted under 35 U.S.C. 154(b) by 300 days.

(21) Appl. No.: 11/121,758

(22) Filed: May 4, 2005

(65) Prior Publication Data

US 2005/0263474 A1 Dec. 1, 2005

Related U.S. Application Data

(60) Provisional application No. 60/568,782, filed on May 5, 2004.

(51) Int. Cl.
*A47B 96/04* (2006.01)

(52) U.S. Cl. ..... 312/408; 108/107; 211/187; 211/190

(58) Field of Classification Search ..... 312/408, 312/410; 108/105, 107, 109, 147.16; 211/175, 211/187, 90.03, 190, 90.02, 103, 134
See application file for complete search history.

(56) References Cited

U.S. PATENT DOCUMENTS

| | | | | | |
|---|---|---|---|---|---|
| 340,949 | A | | 4/1886 | Jackson | |
| 506,829 | A | | 10/1893 | Ohmer | |
| 1,855,242 | A | * | 4/1932 | Jarvis | 108/109 |
| 2,251,799 | A | | 8/1941 | Nave | |
| 2,301,507 | A | * | 11/1942 | Bitney | 108/110 |
| 2,815,649 | A | * | 12/1957 | Di Angelus et al. | 312/408 |
| 2,891,677 | A | * | 6/1959 | Ritchie | 211/59.2 |
| 3,311,072 | A | | 3/1967 | Pattison | |
| 3,797,903 | A | * | 3/1974 | Traulsen | 108/147.15 |
| 4,079,678 | A | * | 3/1978 | Champagne | 108/106 |
| 4,142,638 | A | * | 3/1979 | Vargo | 211/187 |
| 4,248,489 | A | * | 2/1981 | Barroero et al. | 312/296 |
| 4,344,368 | A | | 8/1982 | Remington et al. | |
| 4,348,001 | A | * | 9/1982 | Baldwin | 108/109 |

(Continued)

FOREIGN PATENT DOCUMENTS

| | | | | |
|---|---|---|---|---|
| DE | 3915936 | * | 11/1990 | 211/187 |

(Continued)

*Primary Examiner*—Hanh V Tran
(74) *Attorney, Agent, or Firm*—Brinks Hofer Gilson & Lione; Steven P. Shurtz

(57) ABSTRACT

An adjustable shelf system for food equipment includes at least two front brackets, each having a base and a support member extending from the base. The support member has an outer edge and a series of vertically spaced notches. The front brackets are mounted such that the notched support surfaces extend substantially toward each other in a direction generally parallel with a vertical plane that intersects both of the front brackets. A shelf is supported by the front brackets, with extensions extending outwardly from the sides of the shelf. The front of the shelf can be lifted, allowing the shelf to be moved laterally to a position in which the back of the shelf is no longer supported by back support surfaces and the extensions are clear of the notches in the front brackets, thereby allowing the shelf to be moved vertically to a different height while being held horizontal.

27 Claims, 3 Drawing Sheets

U.S. PATENT DOCUMENTS 4,457,239 A * 7/1984 Heinze ..... 108/109
5,622,415 A 4/1997 Felsenthal et al.
5,641,083 A * 6/1997 Metcalf ..... 211/187
5,645,182 A 7/1997 Miller, Jr. et al.
5,884,567 A * 3/1999 Bartz, Jr. ..... 108/106
6,238,032 B1 5/2001 Cooper et al.
6,302,036 B1 * 10/2001 Carson et al. ..... 108/107
6,490,983 B1 * 12/2002 Nicholson et al. ..... 108/106
6,832,562 B2 * 12/2004 Tabor et al. ..... 108/55.1

FOREIGN PATENT DOCUMENTS

FR 2682861 * 4/1993 ..... 211/187

* cited by examiner

ADJUSTABLE SHELVING SYSTEM

REFERENCE TO EARLIER FILED APPLICATION

The present application claims the benefit of the filing date under 35 U.S.C. § 119(e) of Provisional U.S. Patent Application Ser. No. 60/568,782 filed May 5, 2004, which is hereby incorporated by reference in its entirety.

BACKGROUND OF THE INVENTION

The present invention relates to adjustable shelving systems, and particularly to adjustable shelving systems for use in food equipment. A preferred embodiment of the invention is a reach-in cooler with adjustable shelving.

It is very common to provide a cabinet or other storage compartment with shelves so that multiple levels of storage are provided within the compartment. It is also very common to make the shelves so that they are supported in such a way that their height within the cabinet can be changed to fit the needs of the user, which may change over time. For example, reach-in coolers are often used to store containers for display, or to hold items to be used in a commercial food preparation area. At times the containers or other items to be stored may be taller or shorter than at other times. By making the shelves adjustable in height within the reach-in cooler, the user may adapt the shelf spacing to best serve his or her needs.

There are numerous adjustable shelving systems know in the prior art. Some, such as that shown in U.S. Pat. No. 2,251,799 to Nave, utilize shelves that have a mechanical adjustment feature, requiring the shelf itself to be mechanically manipulated. Such mechanical manipulation of the shelves themselves is sometimes complicated and time consuming. Others, such as that shown in U.S. Pat. No. 5,645,182 to Miller, have the shelf supported on hooks that can fit into one of many holes on brackets inside the cabinet. When a shelf is to be adjusted in height, the shelf is typically removed from the cabinet while the hooks are removed from the brackets and moved to a different elevation. One of the problems with this system is that it is time consuming to move each of the hooks, typically four, independently, and making sure that each of the hooks is at the correct elevation, such as by counting the number of holes the hook is moved, or counting down to which hole the hook is placed. Many other systems, such as that shown in U.S. Pat. No. 3,797,903 to Traulsen, require the shelf to be tipped at a steep angle front-to-back or side-to-side during the process of adjusting the height of the shelf.

The adjustable shelf system shown in U.S. Pat. No. 6,238,032 to Cooper has the drawback that it is part of a liner for a specific size cabinet, and cannot be used with other sizes of cabinets without have to remake the entire liner as well.

Thus there is still a need for an improved adjustable shelf system, one which does not require the shelves to be mechanically altered, or tipped side-to-side when moving them from one height to another, and with which height adjustment can be easily and quickly accomplished.

SUMMARY

A new adjustable shelf system has been invented which allows shelves to be quickly and easily moved from one height to another. Moreover, when the shelving system is mounted inside of a cabinet, such as a reach-in cooler, the shelves can be moved from one elevation to another in the cabinet without tipping them side-to-side.

In a first aspect, the invention is an adjustable shelf system in a piece of food equipment comprising at least one series of vertically spaced support surfaces mounted in the food equipment for providing support to a back of a shelf; at least two series of vertically spaced front support surfaces mounted in the food equipment for providing support to a front of a shelf, each include an upstanding projection; and at least one shelf supported by the back support surfaces and the front support surfaces with a front, back and two sides, the shelf having a main shelf surface and at least two extensions, each comprising an opening, extending outwardly from the sides, the extensions and the front support surfaces cooperating so as to support the shelf in a first longitudinal position in which the shelf is prevented from moving laterally due to an interference caused by the upstanding projection passing upwardly through the opening, the front of the shelf being able to be lifted while the back of the shelf remains stationary to disengage said interference, thus allowing the shelf to be moved laterally to a second longitudinal position in which the back of the shelf is no longer supported by the back support surfaces and the openings are clear of the upstanding projections, thereby allowing the shelf to be moved vertically to a different height.

In a second aspect, the invention is a piece of food equipment having an adjustable shelf system comprising at least one series of vertically spaced support surfaces mounted in the food equipment for providing support to a back of a shelf; at least two front brackets, each having a base and a support member extending from the base, the support member having an outer edge, the support member also having a series of vertically spaced notches extending from the outer edge toward the base, the notches having a first elevation and a second elevation lower than the first elevation, the first elevation being located between the edge and the second elevation, and the second elevation being located between the first elevation and the base, the front brackets being mounted vertically in the food equipment such that the second elevation of the notches in the front bracket are at the same elevation as corresponding back support surfaces, the front brackets also being mounted such that the support members extend substantially toward each other in a direction generally parallel with a vertical plane that intersects both of the front brackets; and at least one shelf configured to be supported by the back support surfaces and the front brackets with a front, back and two sides, the shelf having a main shelf surface and at least two extensions extending outwardly from the sides and protruding beyond the periphery of the main shelf surface, the extensions having a thickness such that they can pass laterally through the front bracket notches; the extensions being placed on the shelf, the front brackets and back support surfaces being placed in the food equipment, and the extensions and notches being configured such that in a first longitudinal shelf position, the back of the shelf is supported by one of the at least one series of back support surfaces and the extensions extend into corresponding notches in the front brackets and rest on the second elevation of said notches, and such that the front of the shelf can be lifted to where the extensions clear the first elevation, allowing the shelf to be moved laterally to a second longitudinal shelf position in which the back of the shelf is no longer supported by the back support surfaces and the extensions are clear of the notches in the front brackets, thereby allowing the shelf to be moved vertically to a different height.

In a third aspect, the invention is an adjustable shelf system for a cabinet having a back wall, two sidewalls and at least one doorway, the doorway defining a plane, the system comprising at least two back brackets, each having a base for connecting the bracket to the cabinet and a support member extending from the base and having an outer edge, the support member having a series of spaced notches extending from the outer edge toward the base, the at least two brackets being mounted in the cabinet such that the notches in one bracket are at the same elevation as corresponding notches on the other bracket; at least two front brackets, each having a base for connecting the bracket to the cabinet and a support member extending from the base and having an outer edge, the support member having a series of spaced notches extending from the outer edge toward the base, the notches having a first elevation and a second elevation lower than the first elevation, the first elevation being located between the edge and the second elevation, and the second elevation being located between the first elevation and the base, the front brackets being mounted in the cabinet such that the second elevation of the notches in the front bracket are at the same elevation as corresponding notches on the back brackets, the brackets also being mounted such that the support members extend substantially toward each other in a direction generally parallel with the plane of the doorway; and at least one shelf supported by the brackets in the cabinet with a front, back and two sides, the shelf having a main shelf surface and at least two extensions extending outwardly from the sides and protruding beyond the periphery of the main shelf surface, the extensions having a thickness such that they can pass laterally through the front bracket notches; the extensions being placed on the shelf, the front brackets being placed in the cabinet and the extensions and notches being configured such that in a first longitudinal shelf position, the back of the shelf is supported by the notches in the back brackets and the extensions extend into corresponding notches in the front brackets and rest on the second elevation of said notches, and such that the front of the shelf can be lifted to where the extensions clear the first elevation, allowing the shelf to be moved toward the front of the cabinet to a second longitudinal shelf position in which the back of the shelf is no longer supported by the notches in the back brackets and the extensions are clear of the notches in the front brackets, thereby allowing the shelf to be moved vertically to a different height within the cabinet.

The adjustable shelf system of the present invention can be used in many different kinds of food equipment, including reach-in coolers. When the shelf is in place, it is sturdy and can be loaded with containers without worry about the containers making the shelf tip. Also, the shelf will not move laterally in the cabinet while it is in its normal position. However, it can be easily and quickly moved by raising the front shelf a small amount to where the interference between the upstanding projection and the shelf extension disengages. The shelf can then be moved to a position where it can be lifted up or lowered without having to tip the shelf side-to-side. If desired, the shelf can be raised or lowered without unloading it because the shelf remains nearly horizontal throughout the height adjustment process. In the preferred embodiments, the shelf is symmetrical so that it can be used either front-in-front or front-in-back.

These and other advantages of the invention, as well as the invention itself, will be best understood in view of the attached drawings.

DETAILED DESCRIPTION OF THE DRAWINGS AND PREFERRED EMBODIMENTS OF THE INVENTION

Figure 1:
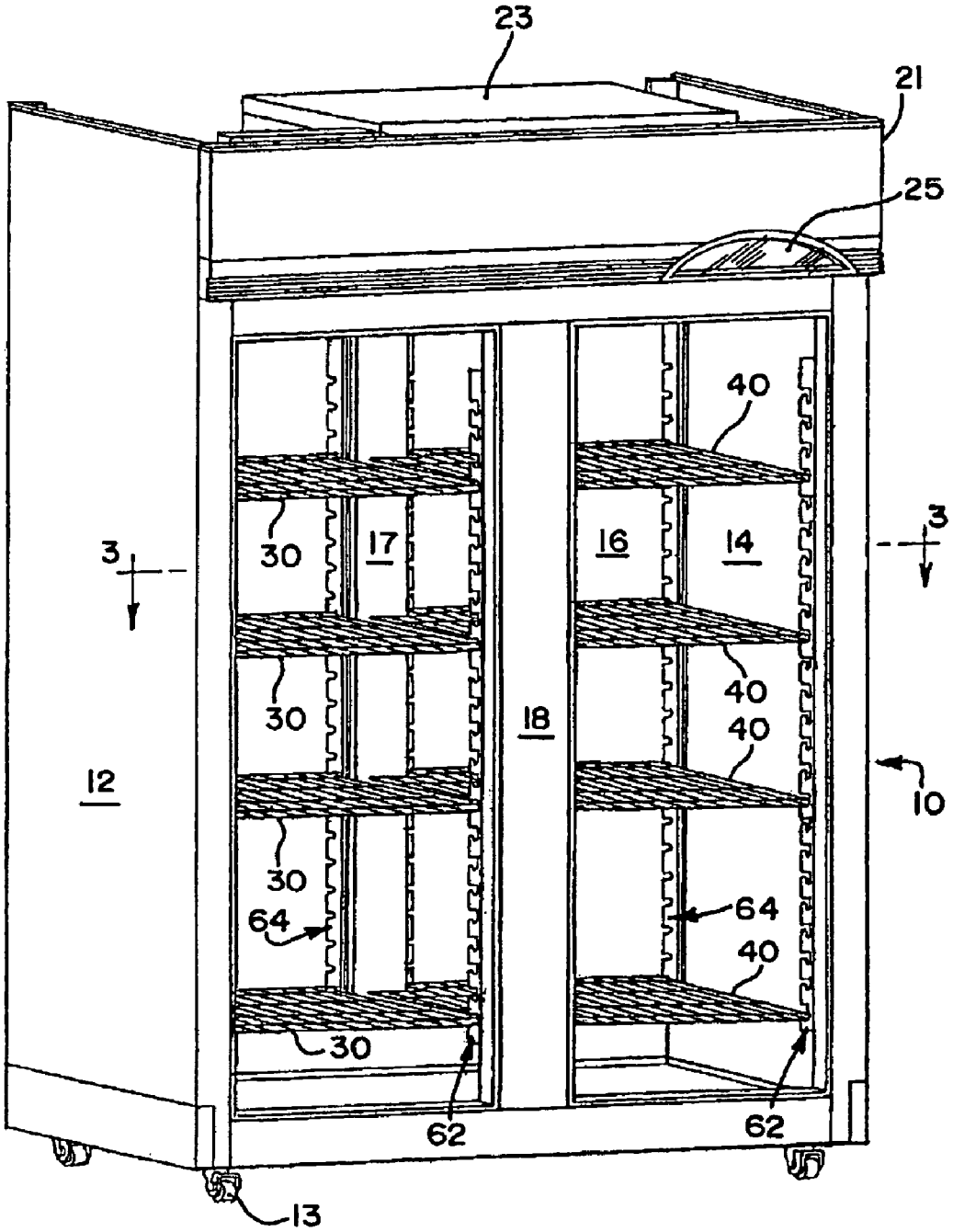
FIG. 1 is a perspective view of a reach-in cooler of the preferred embodiment of the invention, with its doors removed for sake of clarity.

A preferred embodiment of the invention is shown in FIG. 1. An adjustable shelf system for food equipment is utilized in a reach-in cooler 10. The adjustable shelf system can be used in other food storage equipment or apparatus as well. The reach-in cooler 10 has a cabinet comprising a back wall 16, two sidewalls 12 and 14, and at least one doorway. In the reach-in cooler 10 the cabinet is designed for two doors, and hence has two doorways with a mullion 18 between the doorways. However, the doors are removed from the drawing for sake of clarity. The adjustable shelf system of the present invention can be used on cabinets with only one doorway, or with three or more doorways.

Figure 2:
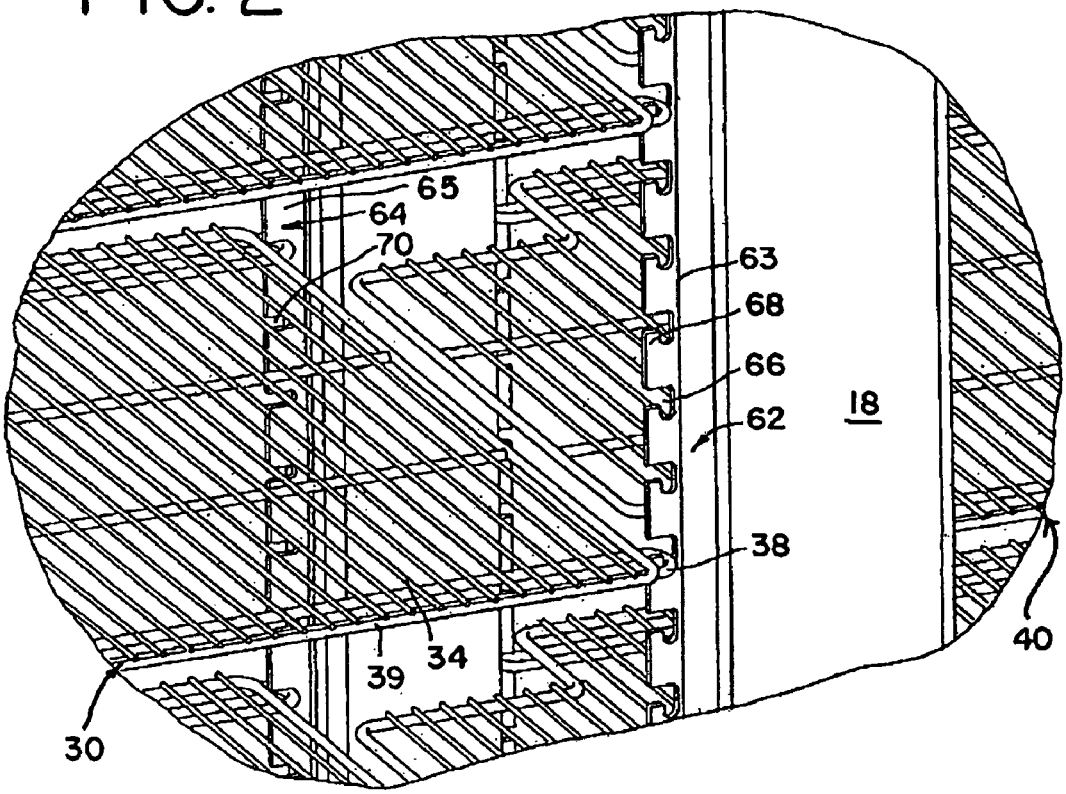
FIG. 2 is a close-up perspective view of the inside of the reach-in cooler of FIG. 1.
Figure 3:
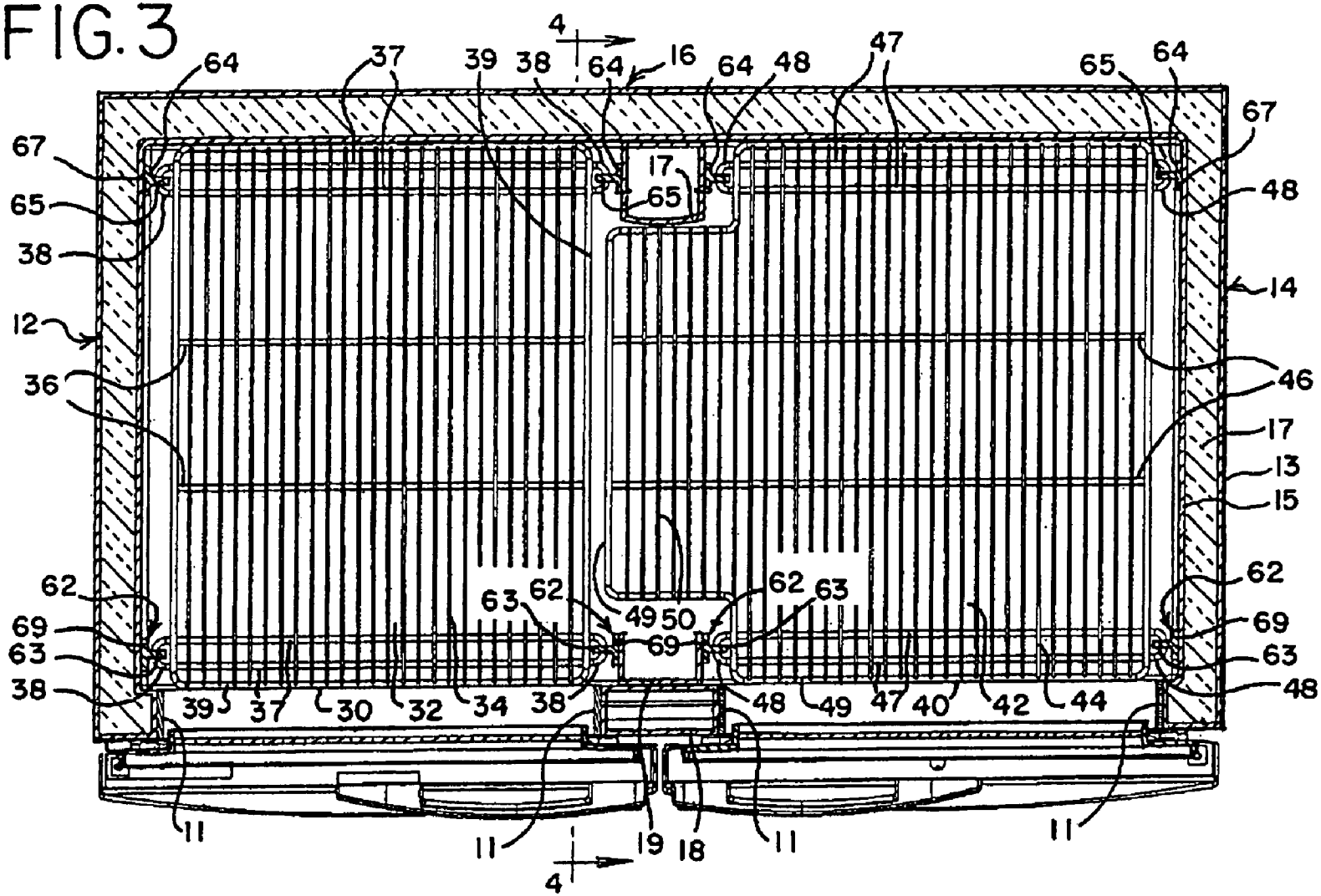
FIG. 3 is a cross-sectional representation taken along line 3-3 of FIG. 1, but showing the doors on the reach-in cooler.

The reach-in cooler 10 also includes a plurality of shelves 30 and 40. One set of shelves 30 are located in the area accessible through the first doorway and the second set of shelves 40 are located in the area accessible through the second doorway. The shelves 30 each have a main shelf surface 32 and the shelves 40 each have a main shelf surface 42. Each shelf has a front, back and two sides, the front and the back defining the depth of the shelf. In this context, the terms "front" and "back" are relative, because the preferred shelves are symmetrical about a plane perpendicular to the main shelf surface and bisecting the shelf, and parallel to the back wall 16. As will be described more fully below, the shelves include and are supported in the cabinet by at least two extensions so as to be adjustable in height. As best seen in FIGS. 2 and 3, the second set of shelves 40 include an extended shelf surface 50 on one side that extends behind the mullion 18 to reach to the main shelf surface 32 of shelves 30.

The shelves 30 are preferably made of wire. The main shelf surface 32 is provided by a top layer of spaced apart, generally parallel, wire strands 34, held together and supported by central cross wires 36 and perimeter wires 39. Two other sets of cross wires 37 are located underneath the perimeter wires and are generally perpendicular to the top wire strands 32. These outer sets of cross wires each have 180° loops 38 connecting their ends. These loops provide the extensions used to support the shelves in the cabinet. The other set of shelves 40 likewise have wire strands 44 held together and supported by central cross wires 46, perimeter wires 49, and two sets of cross wires 47 located underneath the perimeter wires that are generally perpendicular to the top wire strands 42, and have 180° loops 48 connecting their ends.

As best seen in FIG. 3, the cabinet also includes a front and rear pilaster, the front pilaster 19 being positioned behind the mullion 18 and the rear pilaster 17 being adjacent the back wall 16 and laterally spaced to be behind the front pilaster 19.

The reach-in cooler 10 includes other conventional features, such as wheels 13, a top apron 21 behind which a fan compartment 23 or other electrical and refrigeration components can be placed. A display 25 may be used to show the temperature inside the cabinet. The doors include seals to help keep the reach-in cooler 10 cold inside. FIG. 3 is a representation of the cross-section of the reach-in cooler 10.

The walls of reach-in cooler 10 are made of two spaced pieces of sheet metal 13 and 15 with two inch thick polyurethane foam 17 foamed-in-place between them, and thermal breaks 11 at the doorways, as is conventional in the industry.

The reach-in cooler 10 includes at least two series of vertically spaced front support surfaces mounted in the food equipment for providing support to a front of a shelf, each include an upstanding projection. These support surfaces are preferably provided by at least two front brackets 62 mounted in the food equipment so as to be substantially parallel with one another, each with a base 69 (FIG. 3) attached to the cabinet of the food equipment, and a support member 63 extending from the base. For the two-door reach-in cooler, there are four front brackets 62. The bases of the outer front brackets are attached to the sidewalls 12, 14 of the food equipment such that the support members 63 of each front bracket extend generally perpendicular to the sidewall to which the bracket is attached and substantially toward each other in a direction generally parallel with a vertical plane that intersects both of the front brackets. The front brackets near the mullion 18 are mounted on the front pilaster 19.

The support member 63 has an outer edge and a series of vertically spaced notches 66 (FIG. 2) extending from the outer edge toward the base. The notches 66 are at equal elevations on each of the front brackets. Each notch is deeper at a portion adjacent to the base 69 and creates an upstanding projection or finger 68 at the region of the notch away from the base 69. The front brackets are mounted such that the notches 66 in each front bracket open substantially toward the notches of the other front bracket and in a direction generally parallel with a plane that is parallel with and intersects the front brackets. The notches 66 have a first elevation at the top of projection 68 and a second elevation lower than the first elevation in the deeper region of the notch. The first elevation is located between the outer edge of the support member and the second elevation, and the second elevation is located between the first elevation and the base 69. The front brackets are mounted vertically in the food equipment such that the second elevation of the notches in the front bracket is at the same elevation as corresponding back support surfaces (discussed below). The notches are preferably evenly spaced apart from one another on each of the front brackets. The upstanding finger 68 is sized to fit into the opening formed by the 180° loops 38, 48 in the extensions on the shelves 30, 40.

For each set of shelves in the reach-in cooler 10, there is provided at least one, and preferably two, series of vertically spaced support surfaces mounted in the equipment for providing support to the back of a shelf. Preferably each series is provided by a back bracket 64 having a series of vertically spaced notches 70, best seen in FIG. 2. As best seen in FIG. 3, the back brackets 64 each have a base 67 for connecting the bracket 64 to the cabinet and a support member 65 extending from the base and having an outer edge. The support member 65 contains the spaced notches 70, which extend from the outer edge toward the base 67. The notches 70 in the back brackets are of substantially the same width throughout their entire length, and only slightly wider than the thickness of the shelf extension on the back part of the shelf. The two brackets 64 are mounted in the cabinet such that the notches 70 in one bracket are at the same elevation as corresponding notches on the other bracket. The back brackets are preferably mounted such that the notches in the back brackets extend in a direction generally parallel with the plane intersecting the front brackets 62. The outer back brackets 64 are each attached to a sidewall 12, 14 of the food equipment. The back brackets 64 supporting the inside back corners of the shelves are mounted on the rear pilaster 17.

Figure 4:
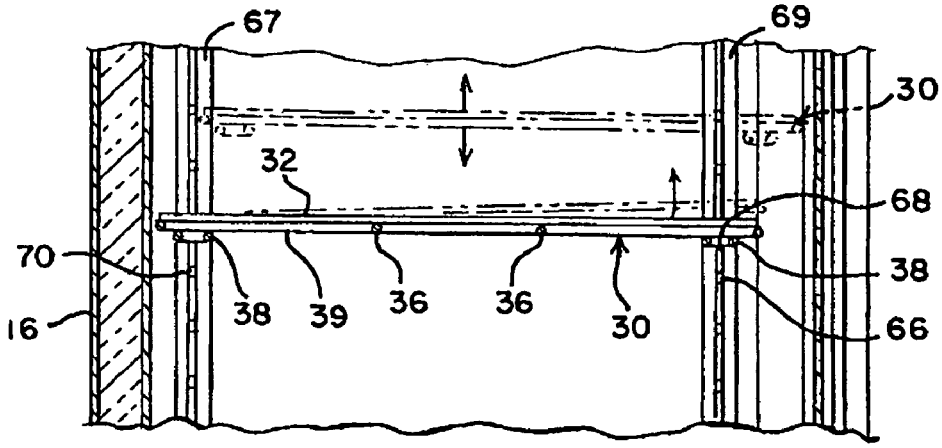
FIG. 4 is a cross-sectional representation taken along line 4-4 of FIG. 3, with a shelf shown in solid lines in its normal supported position, in phantom lines as it is raised in front to disengage the opening in the extension from the upstanding projection, and also in a second set of phantom lines showing the shelf being raised to a second height.

Each of the shelves are configured to be supported by the back support surfaces provided by the notches 70 in the back brackets 64 and by the front support surfaces provided by the notches 66 in the front brackets 62. In the preferred embodiment, each shelf is supported by its extensions 38 or 48. The extensions on the front of the shelves have a width, measured from the front to the back of the shelf, of less than the depth of the shelf, and a thickness such that they can pass laterally through the front bracket notches 66. As noted, these extensions each preferably comprise an opening. The extensions are placed on the shelf, and the front brackets and back support surfaces are placed in the food equipment, and the extensions and notches are configured such that in a first longitudinal shelf position (shown in the solid lines in FIG. 4), the back of the shelf is supported by one of the at least one series of back support surfaces (provided by the notches 70 in the back brackets) and the extensions 38, 40 extend into corresponding notches 66 in the front brackets and rest on the second elevation on those notches. In this first longitudinal position the shelf is prevented from moving laterally due to interference caused by the upstanding projection 68 passing upwardly thought the opening. However, the front of the shelf can be lifted to where the extensions clear the first elevation which the back of the shelf remains stationary to disengage this interference (shown by the lower phantom lines in FIG. 4), allowing the shelf to be moved laterally (toward the front on the cabinet) to a second longitudinal shelf position in which the back of the shelf is no longer supported by the back support surfaces and the extensions are clear of the notches in the front brackets, meaning that the openings are clear of the upstanding projections 68 and the wire loops will not contact the support members of the brackets when the shelf is moved vertically. In this position the shelf may be moved up or down to a different height within the cabinet (shown in the upper phantom lines in FIG. 4.).

Once the shelf is at the desired new elevation, the shelf is moved front-to-back. Once again, the extensions can slide laterally in the front bracket notches to the first position where the extensions can drop into the deeper portion of the notch 66 and cooperate with the upstanding finger 68 to hold the shelf against lateral movement, and the back of the shelf is supported by the back brackets 64.

While four extensions are preferred on each shelf, this is because four brackets are used in each half of the two-door reach-in cooler 10. Each shelf has a number of extensions equal to the total number of front and back brackets used to hold that shelf. It is possible to use some other rear support surfaces rather than brackets, or even notches, and only use brackets with notches on the front. In that case, each shelf would only need two extensions. Of course additional supports can be added to the cabinet for larger shelves.

One benefit of using notches on the back bracket that are of substantially equal width throughout their length and only slightly wider than the thickness of the shelf extension on the back part of the shelf is that then the shelf can not pivot about the front support surfaces and flip up in back if a heavy object is placed on the very front of the shelf. The notches 66 of course need to have a region with a lower elevation, and room for the extensions to slide laterally into place and then drop down, and create the upstanding projection. However, the area above that projection need not be flat as shown in FIG. 2, nor does the projection 68 need to have square corners.

The preferred extensions each comprise a loop of wire having a center opening that fits around the upstanding finger 68. However, other extensions could also be used, so long as they cooperated with the front support surfaces. Preferably the extensions extend from the sides of the shelves about one inch back from the fronts of the shelves. When the shelf is in the first longitudinal position, the back of the shelf is preferably adjacent the back wall 16, and the shelf is moved towards the doorway when being moved into the second longitudinal position. However, the brackets and extensions could be placed such that the shelf is close to the front of the cabinet in its first position, and moved backwards to be disengaged so that it can be raised or lowered. Preferably, the front brackets are mounted on the sidewalls (or two of the four are mounted on the sidewalls and two our mounted on the front pilaster in a two-door cooler) near the doorway so that the front of the shelf is facing the doorway. However, the entire shelf system could be mounted in a cabinet such that one of the "front" brackets is mounted on the front wall and one on the back wall on the left side of the cabinet, in which case the shelf would move side-to-side in going between its first and second positions. Also, the brackets could be used inside of a larger piece of equipment, such as a walk-in cooler, where one or more of the brackets could be freestanding. In these contexts, once again "front" and "back" are recognized to be merely relative to one another, rather than to the cabinet, any doorway therein, or position relative to the user.

The shelves of the preferred embodiment of the invention can be adjusted in height very easily. In fact, for most shelves, the adjustment can be made with one hand. As can be seen, the shelves in the preferred adjustable shelf system do not need to be tipped side-to-side to be moved from one position to another inside the cabinet. Also, for cabinets that are approximately 26¼ inches deep in their interior measurement, and have the projection 68 rising ⅜ inches above the support surface provided by the second, lower elevation in notch 66, the shelf can be adjusted after the front of the shelf is lifted less than 1.5° from a horizontal plane.

In one preferred embodiment, the doorway is slightly wider than the extensions. In that embodiment, the shelf can be removed from the reach-in cooler 10 without having to be tipped at a side-to-side angle. This is achievable because the front brackets extend inwardly from the sides of the cabinet, with the notches extending parallel to the plane intersecting the front brackets, and the shelves are supported by extensions that extend outwardly from the sides of the shelves.

It should be appreciated that the products of the present invention are capable of being incorporated in the form of a variety of embodiments, only a few of which have been illustrated and described above. The invention may be embodied in other forms without departing from its spirit or essential characteristics. For example, if the cabinet had only one doorway and one set of shelves, there would be two front brackets 62 and two back brackets 64, and each of the brackets would be mounted directly on the sidewalls.

The described embodiments are thus to be considered in all respects only as illustrative and not restrictive, and the scope of the invention is, therefore, indicated by the appended clams rather than by the foregoing description. All changes that come within the meaning and range of equivalency of the claims are to be embraced within their scope.

What is claimed is:

1. A piece of food equipment having an adjustable shelf system comprising:

a) at least one series of vertically spaced back support surfaces mounted in the food equipment for providing support to a back of a shelf;

b) at least two front brackets, each having a base and a support member extending from the base, the support member having an outer edge, the support member also having a series of vertically spaced notches extending from the outer edge toward the base, the notches having a first elevation and a second elevation lower than the first elevation, the first elevation being located between the edge and the second elevation, and the second elevation being located between the first elevation and the base, the front brackets being mounted vertically in the food equipment such that the second elevation of the notches in the front bracket are at the same elevation as corresponding back support surfaces, the front brackets also being mounted such that the support members extend from the bases substantially toward each other in a direction generally parallel with a vertical plane that intersects both of the front brackets; and c) at least one shelf supported by the back support surfaces and the front brackets with a front, back and two sides, the front and the back defining the depth of the shelf and the two sides defining the width of the shelf, the shelf having a main shelf surface and at least two extensions extending outwardly from the sides between the front and the back and protruding beyond the width of the shelf, the extensions having a width, measured from the front to the back of the shelf, of less than the depth of the shelf, and a thickness such that they can pass laterally through the front bracket notches; the extensions being placed on the shelf, the front brackets and back support surfaces being placed in the food equipment, and the extensions and notches being configured such that in a first longitudinal shelf position, the back of the shelf is supported by one of the at least one series of back support surfaces and the extensions extend into corresponding notches in the front brackets and rest on the second elevation of said notches, and such that the front of the shelf can be lifted to where the extensions clear the first elevation, allowing the shelf to be moved laterally to a second longitudinal shelf position in which the back of the shelf is no longer supported by the back support surfaces and the extensions are clear of the notches in the front brackets, thereby allowing the shelf to be moved vertically to a different height while maintaining the shelf in a substantially horizontal plane.

2. The adjustable shelf system of claim 1 wherein the shelf is made of wire.

3. The adjustable shelf system of claim 2 wherein the extensions each comprise a loop of wire.

4. The adjustable shelf system of claim 1 wherein the shelf is symmetrical about a plane perpendicular to the main shelf surface and bisecting the shelf, and parallel to the plane intersecting the front brackets.

5. The adjustable shelf system of claim 1 wherein there are at least two series of back support surfaces, each series being provided by a back bracket having a series of vertically spaced notches.

6. The adjustable shelf system of claim 5 wherein each shelf comprises four extensions.

7. The adjustable shelf system of claim 1 wherein the notches are evenly spaced apart from one another on each of the front brackets.

8. The adjustable shelf system of claim 2 wherein the notches on the front brackets are formed such that they have an upstanding finger that fits into an opening formed by a loop in the wire.

9. The adjustable shelf system of claim 5 wherein the back brackets are mounted such that the notches in the back brackets extend in a direction generally parallel with the plane intersecting the front brackets.

10. The adjustable shelf system of claim 1 wherein the bases of both of the front brackets are attached to sidewalls of the food equipment, and the support members of each front bracket extend generally perpendicular to the sidewall to which the bracket is attached.

11. The adjustable shelf system of claim 5 wherein the notches in the back brackets are of substantially the same width throughout their entire length.

12. The adjustable shelf system of claim 10 wherein there are at least two series of back support surfaces, each series being provided by a back bracket having a series of vertically spaced notches, and the back brackets are also each attached to a sidewall of the food equipment.

13. A food storage apparatus having a back wall, two sidewalls, at least one doorway and a plurality of shelves, the shelves being supported inside the apparatus so as to be adjustable in height, comprising:

a) at least two front brackets mounted in the apparatus so as to be substantially parallel with one another, each with a base attached to the apparatus and a set of notches, the notches being at equal elevations on the two brackets, each notch being deeper at a portion adjacent to the base and creating an upstanding finger at the region of the notch away from the base, the front brackets also being mounted such that the notches in each front bracket extend from the bases substantially toward each other and in a direction generally parallel with a plane that is parallel with and intersects the front brackets;

b) at least two back brackets each with a base attached to the apparatus and a set of notches at equal elevations with the notches in the front brackets; and c) the shelves each having a front, back and two sides, the front and the back defining the depth of the shelf and the two sides defining the width of the shelf, at least two extensions extending outwardly from the sides between the front and the back and protruding beyond the width of the shelf, the extensions having a width, measured from the front to the back of the shelf, of less than the depth of the shelf, and sized, positioned on the shelves and configured such that as the shelves are moved back-to-front and front-to-back in the apparatus, the extensions can slide laterally in the front bracket notches to a first position where the extensions can drop into the deeper portion of the notch and cooperate with the upstanding finger to hold the shelf against lateral movement and the back of the shelf is supported by the back brackets, and to a second position where the shelf can be moved vertically without the extensions contacting the front brackets and the shelf contacting the notches in the back brackets while maintaining the shelf in a substantially horizontal plane.

14. The food storage apparatus of claim 13 wherein each shelf has a number of extensions equal to the total number of front and back brackets.

15. The food storage apparatus of claim 13 wherein the extensions extend from the sides of the shelves about one inch back from the fronts of the shelves.

16. The food storage apparatus of claim 13 wherein the extensions comprise loops of wire having a center opening that fits around the upstanding finger.

17. The food storage apparatus of claim 13 wherein the apparatus has at least two doorways and a mullion between the doorways.

18. The food storage apparatus of claim 17 wherein one set of shelves are located in the area accessible through a first doorway and a second set of shelves are located in the area accessible through a second doorway, and the second set of shelves include an extended shelf surface that extends behind the mullion.

19. The food storage apparatus of claim 17 wherein the apparatus includes a front and rear pilaster, the front pilaster being positioned behind the mullion and the rear pilaster being adjacent the back wail and laterally spaced to be behind the front pilaster, and the front brackets near the mullion are mounted on the front pilaster and the back brackets supporting the inside back corners of the shelves are mounted on the rear pilaster.

20. The food storage apparatus of claim 13 wherein the apparatus comprises a reach-in cooler.

21. An adjustable shelf system in a cabinet having a back wall, two sidewalls and at least one doorway, the doorway defining a plane, the system comprising:

a) at least two back brackets, each having a base for connecting the bracket to the cabinet and a support member extending from the base and having an outer edge, the support member having a series of spaced notches extending from the outer edge toward the base, the at least two brackets being mounted in the cabinet such that the notches in one bracket are at the same elevation as corresponding notches on the other bracket;

b) at least two front brackets, each having a base for connecting the bracket to the cabinet and a support member extending from the base and having an outer edge, the support member having a series of spaced notches extending from the outer edge toward the base, the notches having a first elevation and a second elevation lower than the first elevation, the first elevation being located between the edge and the second elevation, and the second elevation being located between the first elevation and the base, the front brackets being mounted in the cabinet such that the second elevation of the notches in the front bracket are at the same elevation as corresponding notches on the back brackets, the brackets also being mounted such that the support members extend from the bases substantially toward each other in a direction generally parallel with the plane of the doorway; and c) at least one shelf supported by the brackets in the cabinet with a front, back and two sides, the front and the back defining the depth of the shelf and the two sides defining the width of the shelf, the shelf having a main shelf surface and at least two extensions extending outwardly from the sides between the front and the back and protruding beyond the width of the shelf, the extensions having a width, measured from the front to the back of the shelf, of less than the depth of the shelf, and a thickness such that they can pass laterally through the front bracket notches; the extensions being placed on the shelf, the front brackets being placed in the cabinet and the extensions and notches being configured such that in a first longitudinal shelf position, the back of the shelf is supported by the notches in the back brackets and the extensions extend into corresponding notches in the front brackets and rest on the second elevation of said notches, and such that the front of the shelf can be lifted to where the extensions clear the first elevation, allowing the shelf to be moved toward the front of the cabinet to a second longitudinal shelf position in which the back of the shelf is no longer supported by the notches in the back brackets and the extensions are clear of the notches in the front brackets, thereby allowing the shelf to be moved vertically to a different height within the cabinet while maintaining the shelf in a substantially horizontal plane.

22. The adjustable shelf system of claim 21 wherein the shelf can be adjusted after the front of the shelf is lifted less than 1.5° from a horizontal plane.

23. A reach-in cooler having a back wall, two sidewalls and at least one doorway and including the adjustable shelf system of claim 1.

24. The reach-in cooler of claim 23 wherein one of the front brackets is mounted on each of the sidewalls near the doorway so that the front of the shelf is facing the doorway.

25. The reach-in cooler of claim 24 wherein when the shelf is in the first longitudinal position, the back of the shelf is adjacent the back wall, and the shelf is moved towards the doorway when being moved into the second longitudinal position.

26. The reach-in cooler of claim 23 wherein the doorway is slightly wider than the distance between the outermost parts of the extensions, and the shelf can be removed from the reach-in cooler without having to be tipped at a side-to-side angle.

27. The reach-in cooler of claim 23 wherein the shelf is made of a top layer of spaced apart generally parallel wire strands held together and supported by cross wires underneath and generally perpendicular to the top wire strands, and the extensions comprise 180° loops in the cross wires.

* * * * *

UNITED STATES PATENT AND TRADEMARK OFFICE

CERTIFICATE OF CORRECTION

PATENT NO. : 7,533,948 B2
APPLICATION NO. : 11/121758
DATED : May 19, 2009
INVENTOR(S) : Jimmy S. Smith et al.

It is certified that error appears in the above-identified patent and that said Letters Patent is hereby corrected as shown below:

In the Claims

In column 10, claim 19, line 4, after "adjacent the back" replace "wail" with --wall--.

Signed and Sealed this

Thirtieth Day of November, 2010

David J. Kappos

David J. Kappos
*Director of the United States Patent and Trademark Office*